United States Patent [19]

Krubsack et al.

[11] Patent Number: 4,975,549

[45] Date of Patent: Dec. 4, 1990

[54] MULTIPLE TERMINAL SWITCH APPARATUS

[75] Inventors: Larry J. Krubsack, Colgate; Allen L. Handy, North Prairie; John G. Lawton, Milwaukee, all of Wis.

[73] Assignee: Clum Manufacturing Company, Inc., Hartland, Wis.

[21] Appl. No.: 414,913

[22] Filed: Sep. 29, 1989

[51] Int. Cl.[5] ..... H01H 21/76; H01H 27/06

[52] U.S. Cl. ..... 200/11 C; 200/43.08

[58] Field of Search ..... 200/11 C, 11 J, 11 K, 200/43.08, 294–296

[56] References Cited

U.S. PATENT DOCUMENTS 3,311,718 3/1967 Allison et al. ..... 200/11 K 4,320,266 3/1982 Leiter et al. ..... 200/11 C X

*Primary Examiner*—J. R. Scott

*Attorney, Agent, or Firm*—Andrus, Sceales, Starke & Sawall

[57] ABSTRACT

A keylock switch has a standard housing and rotary switch unit for two, three, four, five or six terminals. The switch includes an outer housing has a lock section and an inner contact section closed by a back plate with fixed contacts secured thereto. A keylock assembly includes a rotating tube with edge slots and pivoted locking levers which are pivoted to a release position within the tube. A hub extends from the lock section into a contact chamber and forms a bearing wall, on which a contact carrier plate bears. A rotating U-shaped contact is coupled to the plate bottom and includes an integral leaf spring in the center acting between the carrier and a fixed terminal plate. The U-shaped contact includes opposite end contact plates, with one about twice the width of the other to span two adjacent fixed contacts while the shorter plate engages a single fixed contact. A coil spring encircles the hub, with end ears bearing on spaced ends of a circumferentially extended housing tab to stress the coil carrier spring. A spring tab is located between the ears engages an ear to further stress the coil spring after a selected angle and create a reset force. A stop tab on the carrier and housing limit rotation of the carrier. Fixed contact locations are located on the back plate.

18 Claims, 2 Drawing Sheets

FIG. 1
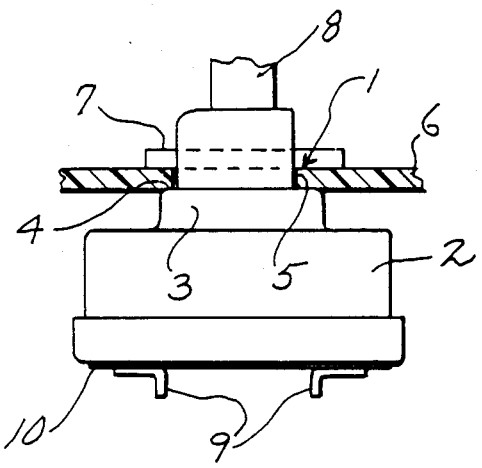
FIG. 4
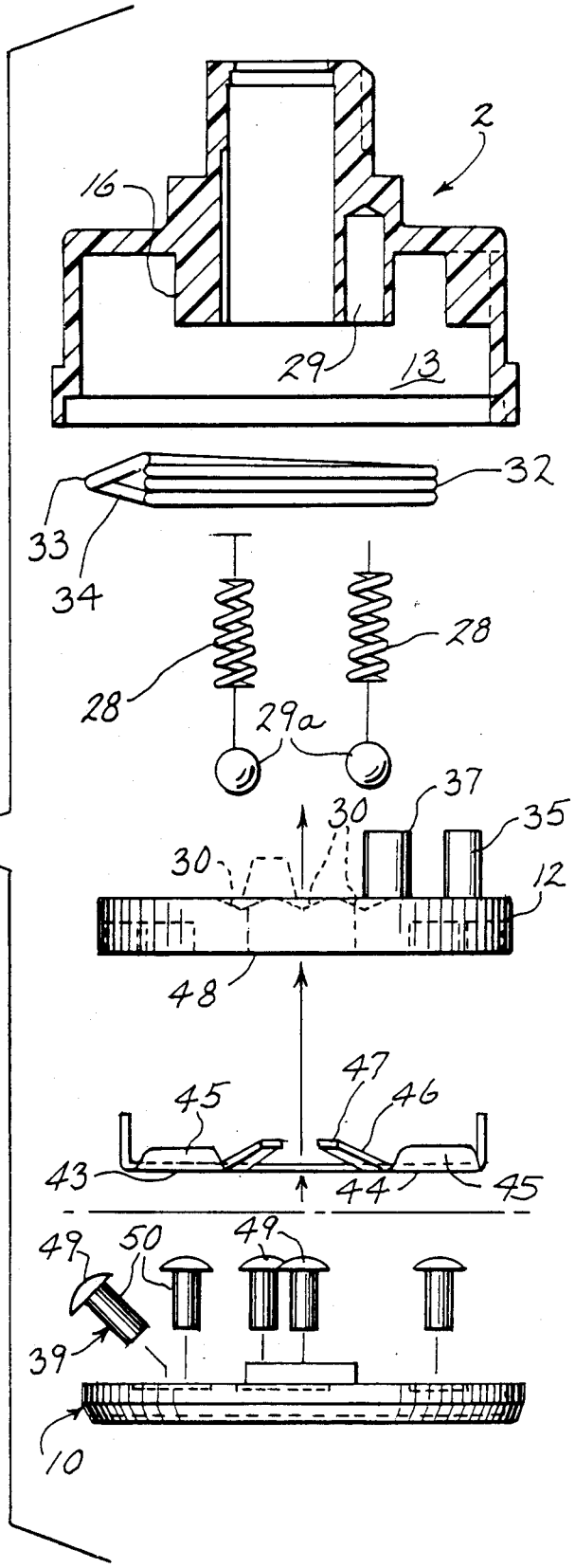
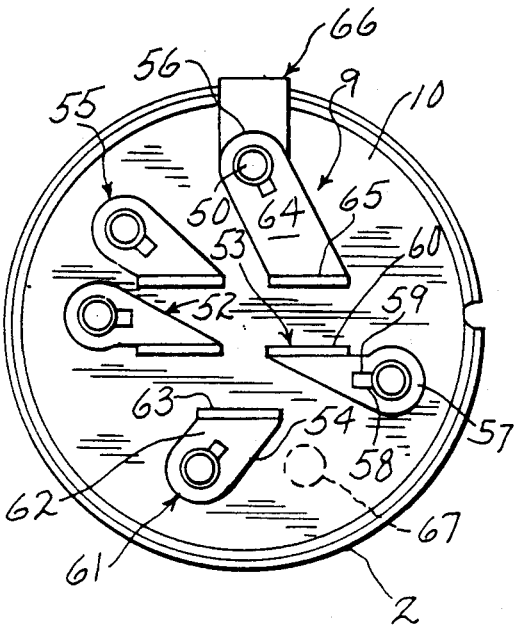
FIG. 2

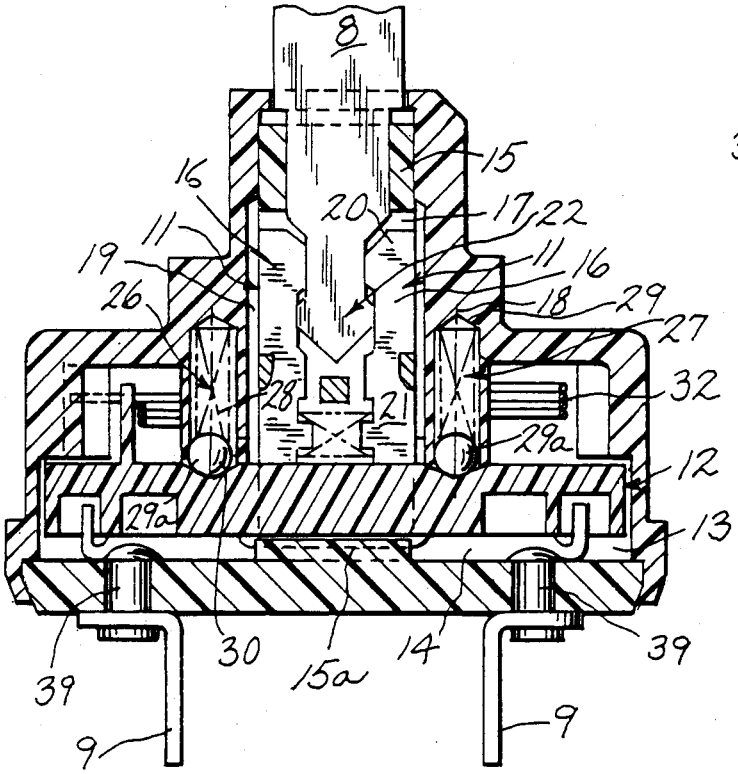
FIG. 3
FIG. 5
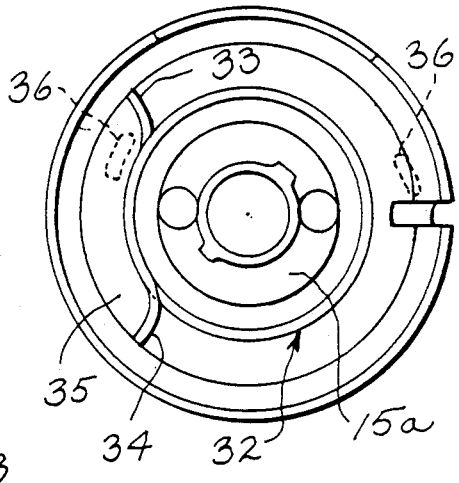
FIG. 7
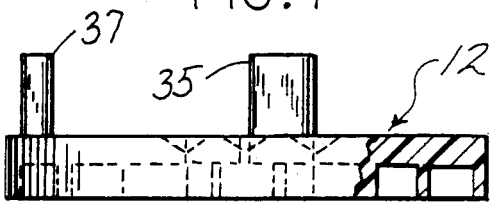
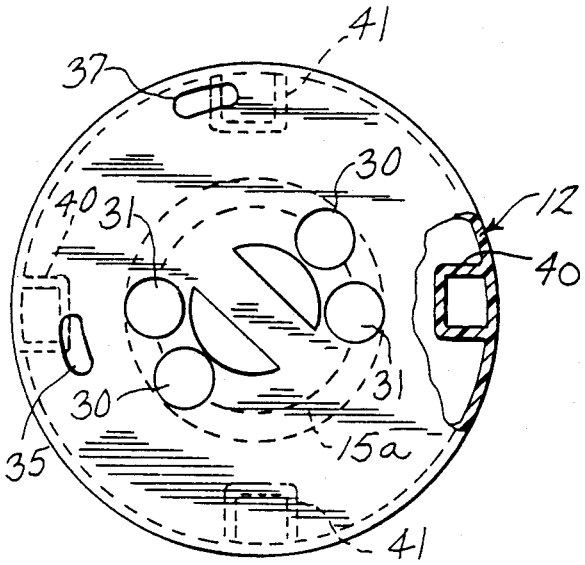
FIG. 6
FIG. 8
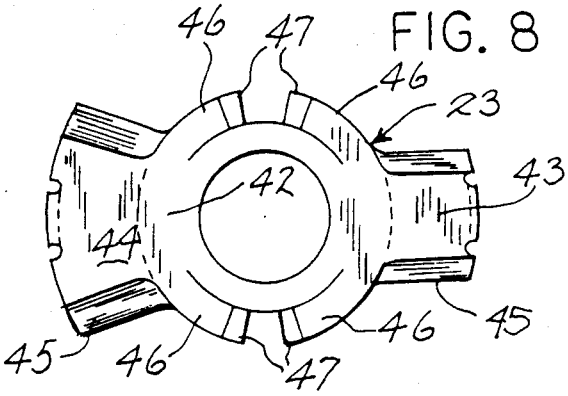

MULTIPLE TERMINAL SWITCH APPARATUS

BACKGROUND OF THE PRESENT INVENTION

This invention relates to a multiple terminal switch apparatus and particularly to such an apparatus including five possible contacts for selectively controlling circuit connections between corresponding five multiple terminals.

Keylock switch structures are often used for controlling of electrical circuits. In many applications, cost factors are of a substantial significance and the security requirements are not equivalent to those required in various applications using conventional tumbler locks. A practical and low cost keylock switch apparatus is disclosed in the, applicant's co-pending application Ser. No. 07/414,914 entitled "Key Lock Apparatus" filed on even date herewith and assigned to a common assignee herewith. As more fully disclosed in such application, a keylock apparatus is illustrated having an outer housing with an internal bore within which a rotatable lock assembly is secured and direct coupled to a rotating contact assembly. The keylock system includes a pair of spaced locking levers having a control leg and a lock leg. The levers are pivotally mounted within the housing bore with a resilient biasing of the locking legs into locking engagement with a groove on the inner bore of the housing. The control legs have inward projections and an inner enlarged opening defining truncated projections. The key includes a large head for pivoting of the levers to release the lock legs and a following truncated recesses complementing the projections. The large portion simultaneously moves the control legs into locking engagement within the grooves. Only when the key has the truncated recess portion aligned with the truncated projections of the control legs, are the levers appropriately located to hold both the lock legs and the control legs within the rotatable tube and thus spaced from the grooves to permit rotation of the tube in an interconnected contact carrier. The rotatable lock tube includes a projecting end projecting into coupling engagement with corresponding aligned portions of a contact carrier. The illustrated embodiment of the invention shown therein includes a single pair of contact terminals located within an outer wall of the housing. The contact carrier includes a bridging contact for selective engagement with the pair of fixed contacts.

Various applications however require multiple contacts for controlling a plurality of circuits. Ignition systems, particularly off road vehicles, are a typical example. A relatively simple keylock system is often provided. Depending upon the particular features and controls, multiple contacts and various terminal are required. Generally, a range of keylock switch units are required with four or five control terminals. The unit preferably requires a relatively low cost but reliable long life rotary apparatus for selectively positioning of a contact carrier connecting power to the several control contacts. Further, the contacts should be located such that common terminals can be selectively secured to a standard housing structure, thereby minimizing the assembly and component cost.

Various multiple contact keylock units are disclosed in the prior art. The prior art generally provides separate designs and constructions for the different applications. The prior art custom design does not provide a highly effective and low cost structure providing a simple configuration for adaptation to two, three, four, five and six terminal controls.

SUMMARY OF THE PRESENT INVENTION

The present invention is particularly directed to a multiple terminal switch apparatus and particularly to such an apparatus having a standard basic construction adapting the unit for two, three, four, five and six terminal switching systems.

Generally in accordance with the present invention, the switch unit includes an outer housing having a keylock section in combination with an inner contact section. The switch unit is preferably constructed in accordance with applicant's co-pending application Ser. No. 07/414,914 and includes a keylock assembly within the control section having a rotating tube member with a coupling end projecting into the contact section. A contact carrier is rotatably mounted within the contact section of the housing and includes a central coupling portion connected to and coupled to the inner end of the rotating member from the control section to establish corresponding rotation and positioning of the contact carrier. The contact section in the housing includes a chamber within which the contact carrier is rotatably mounted. The contact carrier includes the coupling portion abutting a housing member forming an extension of the control assembly. Resilient loading units preferably in the form of spring loaded detent balls are mounted within the housing member with the detent balls, preferably of suitable metal, biased downwardly into engagement with detents circumferentially spaced on the wall of the contact carrier, preferably formed of plastic.

In the five terminal unit, the carrier is movable from the off position to a first contact position and is resiliently biased to a second contact position and includes suitable stops establishing a maximum turn position, with automatic return to the second contact position.

In a practical embodiment, the rotating member from the control section projects downwardly into corresponding recesses in the contact carrier. The underside of the carrier is provided with circumferentially spaced recesses for receiving of a U-shaped bridging contact. Rotation of the bridging contact selectively aligns the contact ends to engage various sets of contacts from an open or off contact position. A first contact position for example would provide for connecting of all auxiliary or accessory equipment. A second contact position provides for ignition and power to the accessory equipment while a third spring loaded position provides for a start position and release of the key providing for an automatic reset of the keylock switch unit.

The movable contact is preferably formed with a centrally located integral spring unit to establish a spring force between the carrier and the back terminal plate. The integral spring unit preferably includes struck out portions defining leaf spring members having the outer ends bearing on the contact carrier. The integral spring establishes resilient interengagement between the movable contact and the fixed contact on the back plate as well as resiliently supporting the carrier in coupling to the control member and bearing engagement with the back support wall.

The housing preferably includes an internal hub within the contact chamber forming an extension of the control chamber. The inner end of the hub defines a bearing wall for the backside of the contact carrier. A coil spring encircles the hub with opposite ends including outwardly projecting ears. The housing includes a first wall or tab in outwardly spaced relation to the exterior side of the spring. The ears of the coil spring are expanded and abuts the opposite ends of the tab to locate and stress the coil spring. A stop wall or tab is provided in diametrically spaced relation to the spring tab and co-operates with a stop wall or tab on the contact carrier. Thus, the contact carrier includes a first stop tab located in the assembled relation adjacent the spring tab and between the ends of the spring tab. In the assembled relation, the spring tab is located between the spring ears such that rotation of the carrier effects engagement of the spring ear to provide a resilient return force on the carrier. The spring tab is spaced from the spring ear and is rotatable through a selected angle to effect certain contact engagements prior to interengaging the spring. A second stop tab on the carrier is spaced approximately 90 degrees from the spring tab and is located in spaced relation to the stop tab of the housing to limit the rotation of the assembly including the lock assembly. Rotation of the key assembly to interengage the stop tab on the carrier and the housing provides simultaneous stressing of the spring member to provide an automatic return of the spring member or of the carrier to the alternate position.

The fixed contacts are specially constructed and secured to the back plate in accordance with the rotational movement of the carrier. The fixed contact plate includes five fixed contact locations and a separate ground tab secured to the outer housing to permit construction of a two, three, four, five or six terminal switch apparatus. The housing and internal switch apparatus is the same regardless of the number of fixed contacts secured within the fixed contact plate. Thus, in a five contact assembly, the circuit open position is located with essentially diametric lines to the contact chamber and the housing. A main power contact is located to one side of the off position. An accessory contact is located to the same side of the off position with a corresponding diametrically spaced accessory contact located to the opposite side thereof. The ground tab is connected to the adjacent reference contact. Rotation of the carrier in an appropriate direction expands the accessory contacts and provides interconnection therebetween. The power contacts includes a single power contact connected to the one side of the off position. Second and third contacts are spaced to the opposite side of the off position for selective engagement with the contact carrier. Rotation to the spring position establishes a common contact between a start contact and an ignition contact and the power contact. The spring return resets the contact to an alternate position while maintaining ignition circuitry while opening of the power circuitry.

The fixed contacts are secured to the housing on a common radius or circle for interengagement by the rotating contact.

Several terminals are formed with a minimum number of basic constructions for connection to the fixed contacts. In a preferred construction, each of the contacts includes a mounting base having an interlock with the back plate to prevent rotation of the terminal once assembled to the back plate to thereby firmly lock the terminal in position with the fixed contact. Each terminal includes an offsetting plate extending from the mounting base and terminating in spaced relation to an offset connecting terminal extending essentially normal to the base. Three basic terminals are constructed and provide for all of the various circuit connections. Two of the terminals are formed with a generally elongated triangular extension from the contact connector to the terminal. Two other terminals are formed with somewhat shorter elongated extensions from the round connector and with the plate mounted and inclined edge between the extension. The third terminal provides for a longer extension and a corresponding location of the outer terminal. The extensions project inwardly from the fixed contact circle and locate the several terminals in laterally spaced parallel relationship for convenient, reliable interconnection.

A minimum number of terminal components are required for forming of the various terminal arrangements including a two, three, four, five or six terminal construction.

The present invention has been found to provide a compact and low cost switch apparatus, and particularly a keylock actuated ignition switch.

BRIEF DESCRIPTION OF THE DRAWINGS

The drawings furnished herewith generally illustrate the best mode presently contemplated for the invention and are described hereinafter.

In the drawings:

FIG. 1 is a side elevational view of a five terminal key switch unit constructed in accordance with an embodiment of the present invention;

FIG. 2 is a bottom view of FIG. 1;

FIG. 3 is an enlarged vertical section through the keylock unit taken generally on line 3—3 of FIG. 2;

FIG. 4 is an exploded view of the switch shown in FIGS. 1–3;

FIG. 5 is a bottom elevational view of the housing shown in FIGS. 1–4;

FIG. 6 is a reduced plan view of the contact carrier shown in FIGS. 1–4;

FIG. 7 is a side elevational view of the contact carrier shown in FIG. 6; and FIG. 8 is a separate elevational view of the movable contact secured to the contact carrier;

DESCRIPTION OF THE ILLUSTRATED EMBODIMENT

Referring to the drawings and particularly to FIGS. 1 and 2, a keylock switch unit 1 is illustrated including an outer cylindrical housing with a stepped down portion 3 at a key receiving end. The stepped down portion 3 defines a shoulder 4 for mounting of the keylock switch unit 1 within an opening 5 in a wall structure 6 with the reduce portion projecting through the opening. A locking device 7 is secured to the reduce portion to mount the keylock switch unit 1 to the wall 6. The outer end is adapted to receive a key 8 actuating an internal lock mechanism which is more fully described hereinafter and corresponds to that disclosed in applicant's previously identified co-pending application Ser. No. 07/414,914. The keylock unit is adapted to actuate a contact assembly located within a contact chamber in the outer end of the housing 2 providing interconnection between a plurality of contacts secured to the back wall of the housing 2. In the illustrated embodiment of the invention, a five terminal unit is illustrated as shown most clearly in FIG. 2. Similar terminal units 9 are secured to a back plate 10 on the housing 2. The terminal units 9 are mounted on a common radius circle and have inwardly projecting portions terminating in upstanding terminals. As more fully disclosed hereinafter, three basic similar terminal constructions as illustrated provide for adaptation of the single housing and internal assembly for various terminal arrangements and particularly providing for a three terminal, four terminal or five terminal switch unit.

Referring particularly to FIG. 3, the illustrated embodiment of the invention includes a keylock assembly 11 located within the outer tubular portion 3 of the housing 2. The keylock assembly 11 is coupled to a contact carrier 12 within a contact chamber 13 formed within an inner portion of the housing 2. The several terminal units 9 terminate within the back wall 10 of chamber 13 and are selectively engaged by a U-shaped bridging contact 14 coupled to the contact carrier 12. The keylock assembly is preferably constructed as disclosed in applicant's co-pending application Ser. No. 07/414,914 and is correspondingly illustrated and briefly described herein as necessary to fully understand the functioning and provide a clear description of the present invention. The present invention is particularly directed to the five terminal contact assembly and its interconnection with the rotating carrier. The contact assembly and structure is fully developed and described in detail to clearly describe a preferred embodiment of the present invention.

Referring particularly to FIGS. 3 and 4, the keylock assembly 11 includes a rotating keylock tube 15 rotatably mounted within the bore to the housing portion 3 and an extended hub 15*a* projecting into the contact chamber 13. The tube 15 houses a pair of similar locking levers 16 which are pivotally mounted in alignment with lateral slots 17 in tube 15. The levers 16 are pivotally secured on transverse walls 18 spanning the slots. The opposite ends of the levers 16 move outwardly into aligned grooves 19 on the bore of the housing. The outer ends of the levers constitute control legs 20 while the inner ends define lock legs 21. A coil spring is disposed between the lock legs 21 and tends to pivot the levers with the lock legs 21 moving outwardly into the grooves 19 and the control legs 20 moving inwardly within the contact tube 15. As more fully developed in the previously identified application, a flat strip-like key inserted into the lock pivots the control legs 20 outwardly and simultaneously pivots the locking legs 21 inwardly. Any deflection of the control legs 20 outwardly beyond the position necessary to clear the lock legs 21 from the grooves 19 moves the control legs 20 into the grooves 19 to re-establish a locking position with respect to rotation of the tube. Thus, a key of only one predetermined width will simultaneously effect the release of the lock legs 21 and position the control legs 20 without establishing an alternate lock position. In the illustrated embodiment of the invention, the key is formed with an enlarged head 22 which moves through the control legs 20 causing the control legs 20 to move outwardly to a locking position while releasing of the lock legs 21. Adjacent the initial head portion, recesses complementing the projections on the control legs and defining a key width is precisely locating the levers within the tube with both the lock legs 21 and the control legs 20 spaced from the grooves 19. The tube 15 is now free to rotate, and the key can rotate the lock assembly and carrier. The tube 15 includes inner projections extended inwardly from the lock assembly 11 from the hub 16 into complementing openings in the contact carrier 12. The central portion of the contact carrier 12 includes similar half-moon shaped recesses. The end of the rotating slotted tube 15 fits into the recesses, and thereby effectively couples the tube 15 to the carrier 12 for rotation thereof within the contact chamber 13. A U-shaped contact 23 is coupled to the outer face of the carrier 12 and selectively connects terminal units 9 in accordance with the rotational position of the carrier.

The contact chamber 13 is formed within the inner end of the housing 2 and has a substantially greater radial dimension with respect to the lock assembly 11 and the outer portion of housing 2. The chamber 13 is closed by a back plate 10. The contact carrier 12 is a round plate-like member formed of suitable insulating plastic. The carrier 12 is located between the inner end of the hub 16 and the back plate 10, and is rotatably mounted therein for positioning the bridging contact 23 with respect to the inner end of terminal units 9, as more fully developed hereinafter. The carrier 12 is held abutting the inner flat end edge of the hub 16 by the U-shaped contacts 23. The backside of the carrier is secured in place by a pair of spring detent units 26 and 27 located within the hub 16 and biased outwardly into engagement with the back of the carrier. Each of the detent units 26 and 27 is identically constructed. Referring to unit 26, a coil spring 28 is located within a suitable cylindrical recess or opening 29 in the hub 16. The spring 28 engages a detent ball 29*a*, preferably formed of steel or other suitable metal, and urges the ball outwardly into engagement with the backside of the aligned carrier 12. As shown clearly in FIG. 3, the back wall of the carrier 12 includes a first set of detent recesses 30 and a second set of detent recesses 31 aligned with the detent units 26 and 27 for resiliently holding the carrier 12 in two alternate positions.

The carrier 12 is thereby mounted for setting between two switch positions and momentarily in an alternate spring loaded position, in the illustrated embodiment of the invention, as follows. A large coil spring 32 is located within the switch chamber encircling the hub 16 of the lock assembly. The opposite ends of the coil springs 32 are formed with projecting ears 33 and 34. The housing is formed with an elongated projection or tab 35 formed on its interior wall, as shown most clearly in FIG. 5. The tab as illustrated spans approximately ninety (90° ) degrees and the opposite ends of the tab define spring walls which are shown with inclination of about ten (10° ) degrees. The end ears 33 and 34 of the coil spring 32 are spread and respectively engage the walls to open and stress the torsional coil spring.

The contact carrier 12 includes a spring tab 36 projecting from the backside thereof and projected inwardly between the periphery of the coil spring 32 and the spring tab 35 on the housing. Rotation of the carrier 12 in a counterclockwise direction, as viewed in FIG. 5, moves the spring tab 36 on the carrier 12 into engagement with the one ear of the coil spring 32. Further rotation of the carrier 12 deflects the coil spring 32 increasing the spring stress, and creates a returning force on the carrier 12. Release of the key results in automatic reset of the spring 32 to the full line position shown, with a return of the carrier 12 with the carrier tab located immediately inwardly of the end of the spring tab 35.

The total permitted rotation of the carrier 12 is restricted to prevent abnormal stressing of the mechanism by a suitable interlock on the housing and the carrier. In the illustrated embodiment of the invention, a stop tab 37 is provided on the housing in diametric location to the center of the spring tab 35. The carrier 12 is provided with corresponding stop tab 38 located in spaced relation to the stop tab 37 in the off or standby position of the key lock unit. Counterclockwise rotation of the carrier as viewed in FIG. 5 and as discussed above, causes the stop tab 38 on the carrier 12 to move and, at the limit position, to engage the stop tab 37 on the housing and thereby positively limit the rotation of the key lock assembly and the contact carrier 12 and the movable contact 23, shown as slightly more than ninety (90° ) degrees.

The rotating movable contact 23 and fixed contacts 39 are constructed with respect to each other and with respect to the designed rotation of the carrier 12 to selectively establish engagement of the fixed contacts 39 to each other for providing of the desired circuit connections.

Referring particularly to FIGS. 3 and 6, the contact carrier 12 includes four equicircumferentially spaced recesses or chambers on the outer surface and located to the outer edge of the carrier. Diametrically opposite recess pairs 40 and 41 define first and second cooperating chambers for receiving of the movable U-shaped contact 23. The movable contact 23, as most clearly shown in FIGS. 4 and 8, includes a planar contact plate having a center round section 42 with a first contact member 43 projecting radially outwardly and a second enlarged contact member 44 projecting outwardly from the diametrically opposite side of the section 42. Each of the contact members 43 and 44 include integral side wing portions or edges 45 which are bent outwardly of the contact and provide inclined camming surfaces for selective moving into engagement with the fixed contacts on the inner face of the back plate as hereinafter described.

The central round section 42 of the movable contact 23 includes four struck out spring members 46 integrally formed with the contact. Each of the spring members 46 is similarly constructed as a circumferential ninety (90° ) degree struck out portion on the periphery of the center section 42. The spring member 46 is bent outwardly from the plane of the plate to define a spring arm terminating in a planar ear or tab 47 parallel to the contact members. All of the ears 47 are located in a corresponding planar position. The ears 47 are constructed and spaced in alignment with a circular bearing surface 48 on the opposed surface of the contact carrier 12. The spring members 46 resiliently urge the contact carrier 12 into sliding engagement with the inner flat edge of hub 16, and simultaneously urges and holds the movable contact 23 and particularly contact members 43 and 44 in sliding engagement with the back plate for selective placement into sliding firm engagement with the fixed contacts.

The movable contact is preferably formed of a high conductivity material such as a grade A phosphorus bronze #510 which also provides good spring characteristic in spring member 46.

Each of the fixed contacts consists of a rivot member having an inner rounded 49 head and a shank 50 which projects through an opening in the back plate 10 which is formed of a suitable insulating material.

Each rivet shank 50 extends through the back plate 10 and is rolled onto a base plate of the associated terminal unit 9 for establishing rigid and firm physical and electrical interconnection to the corresponding terminal. The fixed contacts 39 are located on a common radius and circumferentially spaced about the circle to provide for the desired interconnection.

The terminal unit 9 is generally similarly constructed with construction of three basic variations for fabrication of two, three, four, five and six terminal switch units. In the illustrated embodiment of the invention, terminals 52 and 53 are correspondingly constructed, terminals 54 and 55 are correspondingly constructed and terminal 56 as a separate third basic terminal.

Referring to terminal 52, a base plate 57 includes a circular portion. The contact shank extends through the circular portion and rolled over to secure the terminal to the contact. A struck out portion 58 in the plate 57 projects inwardly toward the back plate to form a tab mating with a recess 59 formed in the back plate to form an anti-rotation interlock. The base plate 57 includes a right-triangular portion projecting outwardly from the circular portion and includes a right-angle leg integrally formed with the upstanding terminal connection 60. The opposite leg of the triangular portion projects outwardly to the opposite side of the circular portion.

Referring to terminal 54, a flat base plate 61 includes a similar circular portion similarly connected to the fixed contact portion and a straight projection 62 from the circular portion of a width equal to the diameter of the circular portion. An upstanding terminal connector 63 is integrally formed on the end of the projection 62 and is located in a plane parallel to the terminal connectors 60 of terminals 52 and 53. The terminal 56 is similar to terminal 62 but has a straight projection 64 of a greater length than the other terminals to locate a terminal connector 65 in the plane of an adjacent terminal 53.

A ground tab 66 is shown extending from the outer housing to the side of the back plate 10. In a five terminal unit, as well as a two, three or four terminal switch unit, the illustrated ground tab 66 is connected by connecting strap to the proper terminal unit 9 as a common ground. A six terminal unit is constructed to conform to the illustrated five terminal unit, with a separate ground lead, shown in phantom at 67, connected to the ground tab 66.

The two, three and four terminal units are constructed with the same basic structure as the illustrated five terminal unit, but with the appropriate terminal units 9 including the corresponding fixed contacts 39. The back plates includes openings only for the terminal units for the particular switch unit.

Various modes of carrying out the invention are contemplated as being within the scope of the following claims particularly pointing out and distinctly claiming the subject matter which is regarded as the invention.

We claim:

1. A multiple terminal switch apparatus, comprising a housing having a bore including a control section and a contact section, said housing having a fixed contact plate closing said contact section, a plurality of contacts secured to said contact plate, said fixed contact plate having five defined contact points spaced to define a first pair of diametrically located contacts, a second pair of diametrically located contacts and a third single contact located adjacent one of said pairs, a rotating control member rotatably mounted within said control section, a contact carrier plate rotatably mounted within said contact section, a coupling unit coupling the carrier plate to the control member for selective rotation of the carrier plate, a rotating contact coupled to said carrier plate and located between the carrier plate and the fixed contact plate, said rotating contact spanning said contact plate and having a first contact end and a second contact end on diametric sides of said contact plate, a resilient unit urging the contact carrier in bearing engagement with said housing and said rotating contact in bearing engagement with said contact plate, a return resilient unit having a fixed end and a movable end, a member on said carrier plate located to engage said movable end after selected rotation of said carrier plate and establish a return force to reset the carrier plate and rotating contact.

2. The switch apparatus of claim 1, wherein said first contact end is a flat member having a circumferential length greater than a fixed contact and said second contact end is a flat member having a circumferential length greater than said first contact and spanning said two adjacent fixed contacts.

3. The switch apparatus of claim 1, wherein said rotating contact has a center member including a center opening, said first resilient unit is integral with said rotating contact and the outer edges of said center member including a plurality of spring arms bent outwardly into bearing engagement with said carrier plate.

4. The switch apparatus of claim 1, wherein said carrier plate includes first diametric spaced recesses and circumferentially spaced second diametric spaced recesses, said rotating contact including a substantially planar contact member having end contact members spaced in accordance with said fixed contacts for selective engagement with said contacts, and offset tab members spaced in accordance with said diametric spaced recesses for selective coupling in said recesses.

5. The switch apparatus of claim 4, wherein said planar contact member includes an intermediate struck out portion defining a spring unit projecting into engagement with said carrier plate and forming said first resilient unit.

6. The switch apparatus of claim 1, wherein said control section having a hub extending into said contact section, said contact carrier plate having a center bearing surface aligned with and engaging the end of said hub, said housing having a circumferentially extended wall defining spaced end surfaces, said return resilient unit including a coil sprinq encircling said hub and having spring ears on each end of the coil spring, said ears engaging said end surfaces to stress said coil spring.

7. The switch apparatus of claim 6, wherein said housing includes a stop wall adjacent said carrier plate, and said carrier plate including a stop tab moved into engagement with said stop wall to limit rotation of said carrier plate.

8. The switch apparatus of claim 6, wherein said control chamber includes a wall projecting as a hub member into said contact chamber, said contact carrier plate is rotatably located between said fixed contact plate and said hub and includes a back bearing surface located in opposed abutting relation to the internal end of said hub, said rotating contact including an integral spring unit defining said first resilient unit and projecting outwardly into bearing engagement with said carrier plate for holding said carrier plate in bearing engagement with said hub and said contact in bearing engagement with said back plate, and said coil spring encircles said hub and including adjacent coil ends, said housing having circumferentially spaced coil walls engaging said coil ends and opening said coil spring to stress said coil spring, said carrier plate including a tab projecting from said back of said carrier plate into and between said coil ends whereby rotation of said carrier plate results in engagement with said spring end and further stressing of said coil spring to establish a return force on said carrier plate.

9. The apparatus of claim 8, wherein said integral spring unit includes a struck out portions extending as leaf spring members from said rotating contact into engagement with said contact carrier plate and establishing said resilient loading and force on said carrier plate and said rotating contact.

10. The switch apparatus of claim 9, including detent means including spring members located within spring recesses in said hub and biased outwardly from said hub toward said carrier plate, detent balls located within said spring recesses and urged outwardly into engagement with said carrier plate, said carrier plate having circumferentially spaced detent recesses establishing predetermined stop locations for said carrier plate, said detent balls being formed of a metal and said carrier having a back wall formed of plastic.

11. The apparatus of claim 10, wherein said rotating control member includes a keylock assembly requiring insertion of an encoded key for establishing rotation of said input.

12. The apparatus of claim 11, wherein said control section includes a round control chamber with grooves on diametric sides and said lock assembly includes a pair of opposed levers pivotally mounted within said control chamber in alignment with said grooves, a pivot unit pivotally mounting said levers, said levers including locking legs projecting inwardly of said pivot unit and control legs projecting outwardly of said pivot unit, the inner opposed edges of said locking levers of said control legs including corresponding input projections defining a restricted opening, resilient means engaging said levers and urging said locking legs outwardly into engagement with said grooves, release of said legs requiring insertion of a key of predetermined width in the plane of said levers for insertion between said control legs to pivot said control legs and thereby said locking legs from the grooves without or pivoting of the control legs into said grooves.

13. A multiple terminal keylock switch apparatus, comprising a housing having a bore including a control section and a contact section, a rotating control member rotatably mounted within said control section, a contact carrier plate rotatably mounted within said contact section, a coupling unit coupling the carrier plate to the control member for selective rotation of the carrier plate, a bridging contact having an integral spring member, said bridging contact being located between the carrier plate and the fixed contact plate, said integral spring member urging the contact carrier plate in bearing engagement with said housing and said bridging contact in bearing engagement with said contact plate, a coil spring having a fixed end to a movable end, a spring member on said carrier plate located to engage said movable end after selected rotation of said carrier plate and establish a return force to reset the carrier plate and movable contact.

14. The switch apparatus of claim 13, wherein said carrier plate, includes first diametric spaced recesses and circumferentially spaced second diametric spaced recesses, said movable contact plate being a substantially planar contact plate having end contact members spaced in accordance with said fixed contacts for selective engagement with said contacts, and offset end members spaced in accordance with said diametric spaced recesses for selective coupling in said recesses, said contact plate including an intermediate struck out portion defining a spring unit projecting from said plate into engagement with said carrier plate and resilient mounting of said movable contact within said contact section.

15. The switch apparatus of claim 13, wherein said locking section includes a hub extending into said contact section, said contact carrier plate having a center bearing surface aligned with and engaging the end of said hub, said housing having a circumferentially extended wall defining spaced end surfaces, said coil spring encircling said hub and having spring ears on each end of the coil spring, said ears engaging said end surfaces to stress said coil spring.

16. A rotary switch apparatus comprising a rotary input control, a housing having an internal contact chamber and a back plate closing said contact chamber, a rotary input chamber including an outer opening and an internal hub member projecting into said contact chamber, a round contact carrier rotatably located within said contact chamber and including a back bearing surface located in opposed abutting relation to the internal end of said hub, a substantially flat elongated contact member located between said carrier and said back plate, said contact member including projection tabs extending into said contact carrier for rotation therewith, said contact member being formed of a spring metal and including struck out portions extending as leaf spring members from said contact member into engagement with said contact carrier and establishing a resilient loading and force on said carrier and said contact plate and holding said carrier in bearing engagement with said hub and said contact in bearing engagement with said back plate, a coil spring encircling said hub and including adjacent coil ends, said housing having circumferentially spaced coil walls engaging said coil ends and opening said coil spring to stress said coil spring, said carrier including a tab projecting from said back of said carrier into and between said coil ends whereby rotation of said carrier results in engagement with said spring end and further stressing of said coil spring to establish a return force on said carrier, detent means including a spring member located within said hub and biased outwardly from said hub toward said carrier, detent balls located within said spring recesses and urged outwardly into engagement with said carrier, said carrier having circumferentially spaced detent recesses establishing predetermined stop locations for said carrier, said detent balls being formed of a metal, said carrier having a plastic back wall.

17. The apparatus of claim 16, wherein said rotary input control includes a keylock assembly requiring insertion of an encoded key for establishing rotation of said input control.

18. The apparatus of claim 17, wherein said lock assembly includes a pair of opposed locking levers pivotally mounted within said input chamber, said chamber having a pair of longitudinal grooves aligned with the outer edges of said levers, said levers being pivotally mounted and including locking legs projecting inwardly of said pivot and control legs projecting outwardly of said pivot, the inner opposed edges of said locking levers of said control legs including corresponding input projections defining a restricted opening, resilient means engaging said levers and urging said locking legs outwardly into engagement with said grooves, release of said legs requiring insertion of a key of predetermined width in the plane of said lever for insertion between said control legs to pivot said control legs and thereby said locking legs from the grooves without deflection or pivoting of the control legs into said grooves.

* * * * *

UNITED STATES PATENT AND TRADEMARK OFFICE

CERTIFICATE OF CORRECTION

PATENT NO. : 4,975,549

DATED : December 4, 1990

INVENTOR(S) : LARRY J. KRUBSACK ET AL

It is certified that error appears in the above-identified patent and that said Letters Patent is hereby corrected as shown below:

ON TITLE PAGE:

IN THE REFERENCES ADD: 2,715,661, 8/1955, Miller, 200/11R; 3,239,615, 3/1966, Schink et al, 200/43.08; 3,334,198, 8/1967, Bedocs et al, 200/11c; 3,497,644, 2/1970, Schink et al, 200/11c; IN THE CLAIMS: Claim 6, column 9, line 41, delete "sprinq" and substitute therefor --spring--. Claim 10, column 10, line 17, after "carrier" insert ---plate---, Claim 14, column 10, line 60, after "plate" delete "," (comma); Claim 15, column 11, line 6, delete "locking" and substitute therefor ---control---.

Signed and Sealed this

Fourth Day of August, 1992

*Attest:*

DOUGLAS B. COMER

*Attesting Officer*

*Acting Commissioner of Patents and Trademarks*